US009174243B2

(12) United States Patent
Nakamura

(10) Patent No.: US 9,174,243 B2
(45) Date of Patent: Nov. 3, 2015

(54) SHEET MANUFACTURING APPARATUS AND METHOD FOR MANUFACTURING SHEET

(71) Applicant: SEIKO EPSON CORPORATION, Tokyo (JP)

(72) Inventor: Masahide Nakamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/486,278

(22) Filed: Sep. 15, 2014

(65) Prior Publication Data

US 2015/0090416 A1 Apr. 2, 2015

(30) Foreign Application Priority Data

Oct. 1, 2013 (JP) ..... 2013-206156

(51) Int. Cl.

| | |
|---|---|
| ***D21F 9/00*** | (2006.01) |
| ***B07B 9/00*** | (2006.01) |
| ***D21D 99/00*** | (2006.01) |
| ***B07B 1/22*** | (2006.01) |
| ***B07B 1/18*** | (2006.01) |
| ***B07B 13/16*** | (2006.01) |

(52) U.S. Cl.

CPC ... *B07B 9/00* (2013.01); *B07B 1/18* (2013.01); *B07B 1/22* (2013.01); *B07B 13/16* (2013.01); *D21D 99/00* (2013.01); *D21F 9/00* (2013.01)

(58) Field of Classification Search

USPC ..... 162/263
IPC ..... D21D 5/04
See application file for complete search history.

(56) References Cited

U.S. PATENT DOCUMENTS

2014/0027075 A1 1/2014 Yamagami et al.

FOREIGN PATENT DOCUMENTS

| | | |
|---|---|---|
| JP | 2012-144819 A | 8/2012 |
| JP | 2013-147772 A | 8/2013 |

*Primary Examiner* — Mark Halpern
(74) *Attorney, Agent, or Firm* — Global IP Counselors, LLP

(57) ABSTRACT

A sheet manufacturing apparatus includes comprises a screening unit configured to screen a defibrated material obtained by defibration treatment, and a sheet forming unit configured to form a sheet with the defibrated material screened with the screening unit. The screening unit has a first screening unit to which a plurality of first openings are provided and a second screening unit to which a plurality of second openings larger than the first openings are provided, and the defibrated material is screened by the first screening unit and the second screening unit. The defibrated material is screened at one of either the first screening unit or the second screening unit and thereafter screened at the other, and the sheet forming unit forms the sheet with the defibrated material that does not pass through the first openings and does pass through the second openings.

7 Claims, 4 Drawing Sheets

SHEET MANUFACTURING APPARATUS AND METHOD FOR MANUFACTURING SHEET

CROSS-REFERENCE TO RELATED APPLICATIONS

This application claims priority to Japanese Patent Application No. 2013-206156 filed on Oct. 1, 2013. The entire disclosure of Japanese Patent Application No. 2013-206156 is hereby incorporated herein by reference.

BACKGROUND

1. Technical Field

The present invention relates to a sheet manufacturing apparatus and a method for manufacturing a sheet.

2. Related Art

In sheet manufacturing apparatuses, a so-called wet format has been employed, where a stock material comprising fiber is poured into water, defibration is performed primarily by a mechanical action, and defibrated material are spread and dried to make a sheet again. A sheet manufacturing apparatus of such a wet form requires large amounts of water, and the apparatus is quite large. In addition, considerable time is spent in the maintenance of keeping water treatment facilities in good condition, and the process of drying also takes a large amount of energy.

Sheet manufacturing apparatuses using a dry approach, where water is not utilized to the greatest extent possible, have therefore been proposed in order to reduce scale and conserve energy (see, for example, Japanese laid-open patent publication No. 2012-144819).

Japanese laid-open patent publication No. 2012-144819 discloses defibrating a piece of paper into fibers in a dry defibrating machine, deinking the fibers in a cyclone, passing the deinked fibers through a small-hole screen of a forming drum surface and depositing same onto a mesh belt, to form paper.

When the piece of paper is defibrated in a dry defibrating machine such as is described above, then in some instances a defibrated material having a variety of fiber lengths is produced. When, for example, a defibrated material of short fiber length is admixed into a material for manufacturing paper, then in some instances binding with the other fibers is more difficult, the binding strength of the defibrated material is decreased, and the strength of the paper thus manufactured is decreased.

Also, in some instances it is impossible to completely defibrate the pieces of paper in the dry defibration machine. When undefibrated pieces that have not been defibrated into fibers are admixed into the material for manufacturing the paper, then sometimes the texture of the paper thus manufactured is deteriorated. Sometimes, also, such undefibrated pieces bind less readily with the other fibers and therefore the strength of the paper thus manufactured is decreased.

SUMMARY

The present invention has been made in order to solve the problems described above, at least in part, and can be implemented as the following aspects or application examples.

One aspect of a sheet manufacturing apparatus as in the invention comprises a screening unit configured to screen a defibrated material obtained by defibration treatment, and a sheet forming unit configured to form a sheet with the defibrated material screened by the screening unit. The screening unit has a first screening unit to which a plurality of first openings are provided and a second screening unit to which a plurality of second openings larger than the first openings are provided, the defibrated material being screened by the first screening unit and the second screening unit. The defibrated material is screened by one of the first screening unit and the second screening unit, and thereafter screened with the other of the first screening unit and the second screening unit, and the sheet forming unit is configured to form the sheet with the defibrated material that does not pass through the first openings and does pass through the second openings.

With the sheet manufacturing apparatus of such description, the defibrated material that passes through the second openings larger than the first openings is used, meaning that long fibers or undefibrated pieces that do not pass through the second openings are not used. Also, the defibrated material that does not pass through the first openings smaller than the second openings is used, meaning that short fibers such as would end up passing through the first openings are not used. Using the defibrated material that does not pass through the first openings and does pass through the second openings makes it possible to remove short fibers, long fibers, and undefibrated pieces, and means that fibers of a length within a predetermined range are used. As such, the sheet manufacturing apparatus of such description is able to manufacture a sheet of high strength.

Furthermore, with the sheet manufacturing apparatus of such description, the fact that the undefibrated pieces can be removed means that a sheet of favorable texture can be manufactured.

In a sheet manufacturing apparatus as in the invention, the configuration may be such that the first screening unit is movable, and the first screening unit is configured to move faster than the second screening unit.

With the sheet manufacturing apparatus of such description, because the first openings of the first screening unit are smaller than the second openings, the first openings end up being blocked by the defibrated material that does not pass through the first openings. Therefore, the short fibers that need to pass through the first openings end up being likely to be prevented from passing through by the other defibrated material. Thus, having the first screening unit move faster than the second screening unit increases the centrifugal force and facilitates passage of the short fibers. The sheet manufacturing apparatus of such description can reliably remove the short fibers and can increase the strength of the resulting sheet.

In a sheet manufacturing apparatus as in the invention, the configuration may be such that the first screening unit is movable, the second screening unit is movable, and the first screening unit is configured to move faster than the second screening unit.

With the sheet manufacturing apparatus of such description, because the first openings of the first screening unit are smaller than the second openings, the first openings end up being blocked by the defibrated material that does not pass through the first openings. Therefore, the short fibers that need to pass through the first openings end up being likely to be prevented from passing through by the other defibrated material. Thus, having the first screening unit move faster than the second screening unit increases the centrifugal force and facilitates passage of the short fibers. The sheet manufacturing apparatus of such description can reliably remove the short fibers and can increase the strength of the resulting sheet.

A sheet manufacturing apparatus as in the invention may comprise a transferring unit configured to transfer, to the second screening unit, the defibrated material that does not pass through the first openings.

With the sheet manufacturing apparatus of such description, the defibrated material that does not pass through the first openings is transferred to the second screening unit, and therefore the second screening unit is further downstream than the first screening unit in a direction of transfer of the defibrated material. Therefore, the defibrated material that passes through the second screening unit can be directly deposited to form the sheet.

A sheet manufacturing apparatus as in the invention may comprise a transferring unit configured to transfer, to the first screening unit, the defibrated material that does pass through the second openings.

With the sheet manufacturing apparatus of such description, the defibrated material that passes through the second openings is transferred to the first screening unit, and therefore the first screening unit is further downstream than the second screening unit in a direction of transfer of the defibrated material. For this reason, a state is enacted where the long fibers and undefibrated pieces have been removed in the first screening unit, and there is less of a possibility that the smaller first openings could be blocked off and the short fibers more readily pass through the first openings.

A sheet manufacturing apparatus as in the invention may comprise a defibrating unit configured to perform the defibration treatment of a material to be defibrated, and a return transferring unit configured to return to the defibrating unit the defibrated material that does not pass through the second openings.

With the sheet manufacturing apparatus of such description, residual material (for example, a residual material that includes undefibrated pieces, fibers that are entangled with one another and increased in size, and long fibers) that is not screened can undergo the defibration treatment in the defibrating unit. That is to say, the residual material need not be discarded but can instead be utilized to the manufacture of sheets.

In a sheet manufacturing apparatus as in the invention, the configuration may be such that the sheet forming unit includes a depositing unit configured to receive and deposit the defibrated material screened by the screening unit, and the sheet forming unit is configured to form the sheet with the defibrated material received by the depositing unit.

With the sheet manufacturing apparatus of such description, the defibrated material received by the depositing unit is constituted of fibers of a length within a predetermined range, and therefore a sheet of high strength and favorable texture can be manufactured.

One aspect of a method for manufacturing a sheet as in the invention comprises screening a defibrated material obtained by defibration treatment, and forming the sheet with the defibrated material that has been screened. The defibrated material is screened by a first screening unit to which a plurality of first openings are provided and a second screening unit to which a plurality of second openings larger than the first openings are provided, and the sheet is formed with the defibrated material that does not pass through the first openings and does pass through the second openings.

With the method for manufacturing a sheet of such description, a sheet of high strength and favorable texture can be manufactured.

BRIEF DESCRIPTION OF THE DRAWINGS

Referring now to the attached drawings which form a part of this original disclosure.

DETAILED DESCRIPTION OF EXEMPLARY EMBODIMENTS

Preferred embodiments of the present invention shall be described in greater detail below, with reference to the accompanying drawings. The embodiments described below also are not intended to improperly restrict the content of the present invention, as set forth in the claims. Furthermore, all of the configurations described below are not necessarily essential constituent elements of the present invention.

First Embodiment

Figure 1:
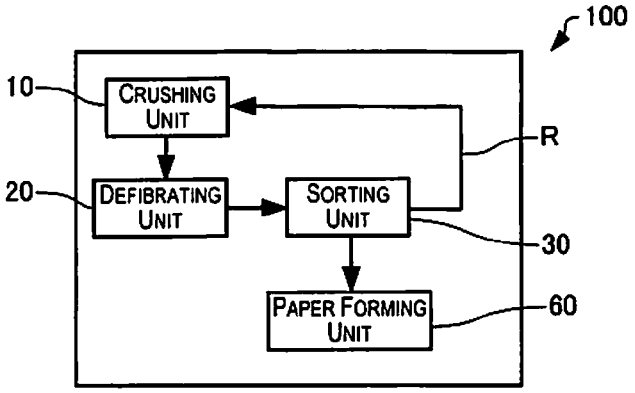
FIG. 1 is a drawing for describing a sheet manufacturing apparatus as in a first embodiment.
Figure 2:
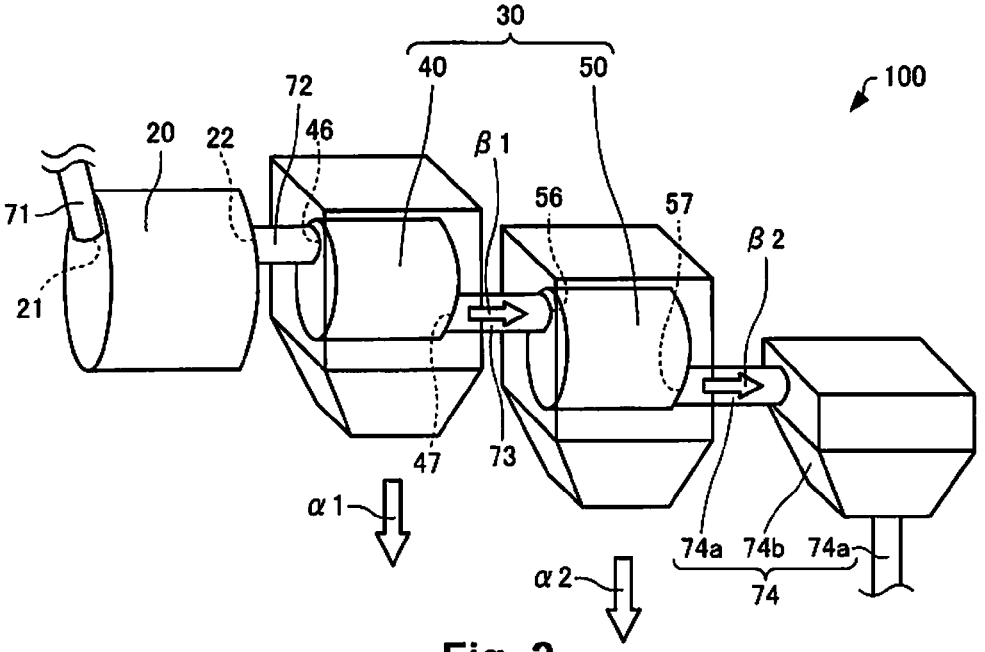
FIG. 2 is a drawing for schematically illustrating a defibrating unit and selection units of a sheet manufacturing apparatus as in the first embodiment.
Figure 3:
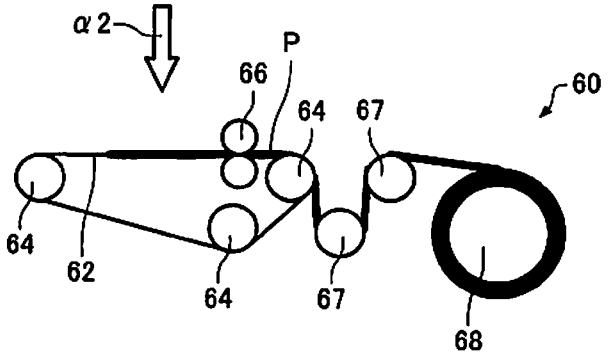
FIG. 3 is a drawing for schematically illustrating a sheet forming unit of a sheet manufacturing apparatus as in the first embodiment.

First, a sheet manufacturing apparatus as in a first embodiment shall be described, with reference to the accompanying drawings. FIG. 1 is a drawing for describing a sheet manufacturing apparatus 100 as in the present embodiment. FIG. 2 is a drawing for schematically illustrating a defibrating unit 20 and a screening unit 30 of the sheet manufacturing apparatus 100 as in the first embodiment. FIG. 3 is a drawing for schematically illustrating a sheet forming unit 60 of the sheet manufacturing apparatus 100 as in the first embodiment.

The sheet manufacturing apparatus 100, as illustrated in FIGS. 1 to 3, comprises: a crushing unit 10; the defibrating unit 20; the screening unit 30, which has a first screening unit 40 and a second screening unit 50; and the sheet forming unit 60.

Pulp sheets or a stock material such as sheets that is inserted (for example, A4-sized used paper) are cut in the air by the crushing unit 10 and made into pieces of paper. Though not particularly limited, the shape or size of the scraps are, for example, scraps of several centimeters square. The crushing unit 10 has a crushing blade (not shown); this crushing bade makes it possible to cut the inserted stock material. An automatic insertion unit (not shown) for continuously inserting the stock material may be provided to the crushing unit 10.

The crushed paper pieces, having been separated by the crushing unit 10, are transferred to the defibrating unit 20 via a first transferring unit 71, as illustrated in FIG. 2. The first transferring unit 71 has communication with an inlet port 21 of the defibrating unit 20. The shape of the first transferring unit 71 is, for example, tubular, as is the shape of a second and third transferring unit 72, 73 described below.

Figure 4:
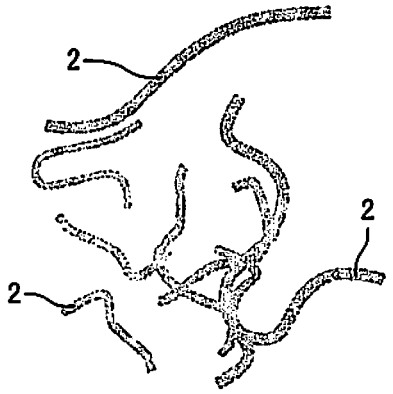
FIG. 4 is a drawing for schematically illustrating a defibrated material.
Figure 5:
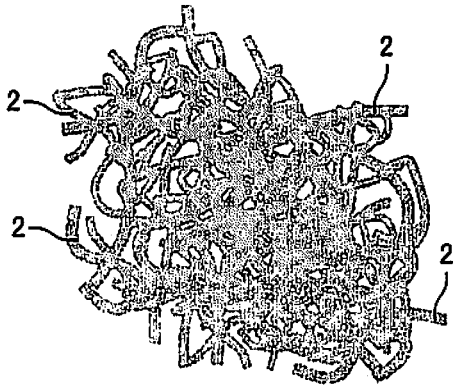
FIG. 5 is a drawing for schematically illustrating a defibrated material.

The defibrating unit 20 subjects the scraps (material to be defibrated) to a defibration treatment. By subjecting the scraps to the defibration treatment, the defibrating unit 20 generates fibers 2 that have been unraveled into the form of fibers. Here, FIGS. 4 and 5 are drawings that schematically illustrate the unraveled fibers 2.

Here, the "defibration treatment" refers to when the scraps, obtained when a plurality of fibers are bonded together, are unraveled into fibers one by one. What has passed through and comes out of the defibrating unit 20 is called the "defibrated material". In addition to the unraveled fibers 2, the "defibrated material" could also in some instances comprise particles of a resin (a resin for bonding the plurality of fibers together) separated from the fibers when the fibers are being unraveled, or ink particles of ink, toner, an anti-bleeding material, or the like. In the description that follows, the "defibrated material" is at least some of what passes through, and may also be an admixture of things added after passage through the defibrating unit 20. Of what is defibrated by the defibrating unit 20, what is supplied to the screening unit 30 described below is called a "defibrated material obtained by defibration treatment". The shape of the unraveled fibers 2 is a string shape or ribbon shape. However, though the unraveled fibers 2 are present in a state of not being entangled with other unraveled fibers (a free state), as illustrated in FIG. 4, the unraveled fibers 2 may in some instances also be present in a state of having entangled with other unraveled fibers 2 to form clumps (a state where so-called "lumps" are formed), as illustrated in FIG. 5. The length of the unraveled fibers 2 (the length in the longitudinal direction of the unraveled fibers 2, also called the "fiber length" below) is, for example, 50 μm to 10 mm. The "fiber length" refers to the distance between two ends when the two ends of a single free fiber are pulled taut so as not to break, as needed, and then placed directly in a substantially rectilinear state. The cross-sectional shape of the unraveled fibers 2 is not particularly limited and may be polygonal, or may be circular or elliptical. The language referring to the "fibers" below is understood to primarily refer to the unraveled fibers.

Figure 6:
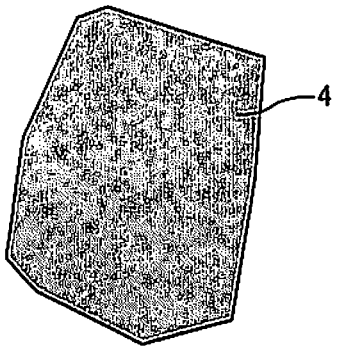
FIG. 6 is a drawing for schematically illustrating an undefibrated piece.

The "defibrated material" may in some instances also comprise "undefibrated pieces". "Undefibrated pieces" are debris that forms when the scraps introduced to the defibrating unit 20 are torn up without being defibrated into fibers, as is schematically illustrated in FIG. 6. That is to say, the undefibrated pieces 4 are strips that have undergone the defibration treatment in the defibrating unit 20 but have not been defibrated. The shape of the undefibrated pieces is not particularly limited, and the size of the undefibrated pieces 4 is, for example, 1 to 10 mm, when represented by the mesh size of a test sieve as measured by a sieving method. The "defibration treatment" signifies when the material to be defibrated (scraps) is introduced to the defibrating unit 20 being driven, and is discharged; as described above, the "defibration treatment" also comprises instances where the undefibrated pieces 4 that have not been defibrated are generated.

The defibrating unit 20 uses a rotating blade to subject the scraps, which are introduced from the inlet port 21, to the defibration treatment. The defibrating unit 20 performs a dry defibration, in air.

For the defibrating unit 20, the rotational speed is 3,000 to 10,000 rpm, preferably 4,000 rpm. In a case where the rotational speed is less than 3,000 rpm, then in some instances the proportion of the undefibrated pieces 4 will be greater. In a case where the rotational speed is 10,000 rpm or greater, then in some instances the proportion of the comparatively short fibers will become greater, which could be the cause of a decline in the strength of the sheet thus manufactured.

Preferably, the defibrating unit 20 has a mechanism for generating an air flow. In such a case, the air flow generated by the defibrating unit 20 enables the defibrating unit 20 to suction the scraps in along with the air flow from the inlet port 21, subject the scraps to the defibration treatment, and transfer the scraps to a discharge port 22. The defibrated material that is discharged from the discharge port 22 is introduced to the screening unit 30 via the second transferring unit 72. In a case where a defibrating unit 20 that does not have an air flow generation mechanism is used, then there may be an externally provided mechanism for generating an air flow for guiding the scraps to the inlet port 21.

The screening unit 30, as illustrated in FIG. 2, has the first screening unit 40 and the second screening unit 50; the fibers 2 obtained by the defibration treatment are screened by the first screening unit 40 and the second screening unit 50. More specifically, from the defibrated material that is introduced to the screening unit 30, the screening unit 30 screens the fibers 2 that do not pass through first openings 42 provided to the first screening unit 40 and do pass through second openings 52 provided to the second screening unit 50.

The "fibers 2 that do not pass through the first openings 42 and do pass through the second openings 52" may refer to fibers 2 that first reach the first openings 42 and do not pass through the first openings 42, and next reach the second openings 52 and do pass through the second openings 52 (an aspect of the sheet manufacturing apparatus 100 as in the first embodiment), or may refer to fibers 2 that reach the second openings 52 and pass through the second openings 52, and next reach the first openings 42 and do not pass through the first openings 42 (an aspect of a sheet manufacturing apparatus 200 as in a second embodiment, described below). The sheet manufacturing apparatus 100 describes a case where the sheet is manufactured using fibers 2 that first reach the first openings 42 and do not pass through the first openings 42, and next reach the second openings 52 and do pass through the second openings 52.

Here, those fibers introduced to the first screening unit 40 that do pass through the first openings 42 are also called a "first passage material α1", and those fibers that do not pass through the first openings 42 are also called a "first residual material β1". Those fibers introduced to the second screening unit 50 that do pass through the second openings 52 are also called a "second passage material α2", and those fibers that do not pass through the second openings 52 are also called a "second residual material β2".

With the screening unit 30, as illustrated in FIG. 2, the defibrated material that is discharged from the defibrating unit 20 is first introduced to the first screening unit 40. The first screening unit 40 separates the defibrated material thus introduced into the first passage material α1 and the first residual material β1. The first residual material β1 thus separated is transferred to the second screening unit 50 via the third transferring unit 73. The first residual material β1 thus introduced is separated by the second screening unit 50 into the second passage material α2 and the second residual material β2. Then, using the second passage material α2 thus separated, the sheet forming unit 60 forms the sheet. In this manner, with the screening unit 30, the first residual material β1 is screened from the defibrated material at the first screening unit 40, and the second passage material α2 is screened from the first residual material β1 at the second screening unit 50. The screening unit 30 shall be described below in greater detail.

Figure 7:
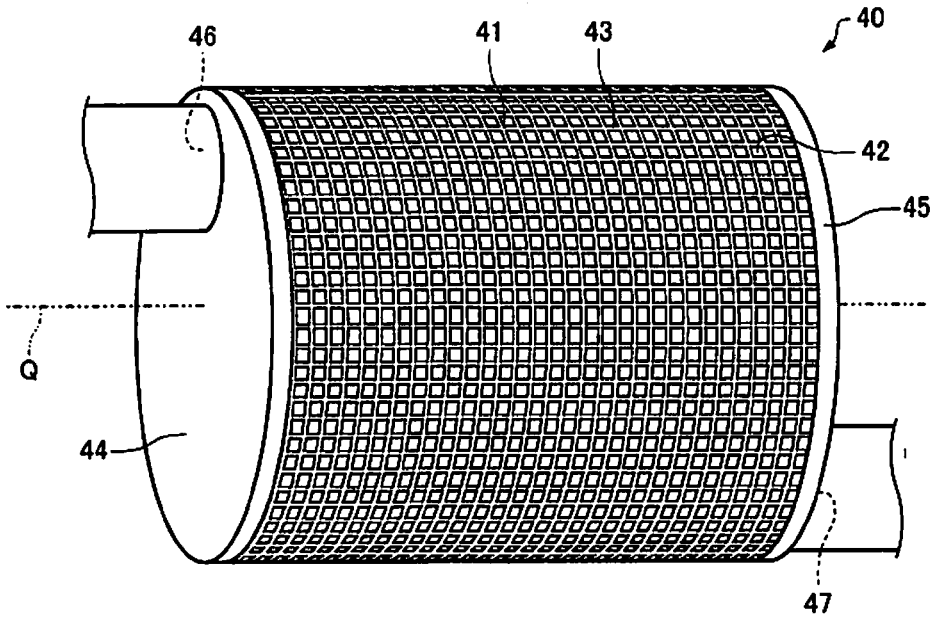
FIG. 7 is a perspective view for schematically illustrating a first selection unit of a sheet manufacturing apparatus as in the first embodiment.
Figure 8:
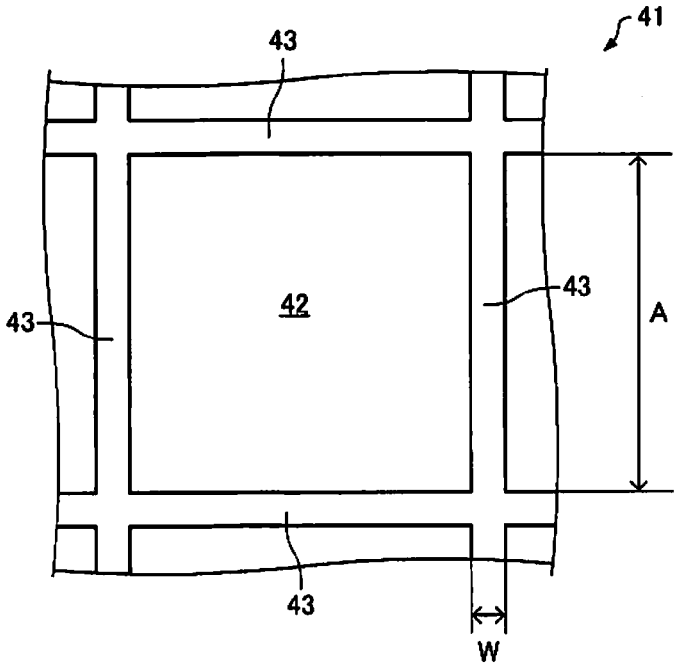
FIG. 8 is a plan view expanding a mesh unit of a first selection unit of a sheet manufacturing apparatus as in a first embodiment.

A sieve is used as the first screening unit 40. Here, FIG. 7 is a perspective view schematically illustrating the first screening unit 40. FIG. 8 is a plan view (expanded view) expanding a mesh unit 41 of the first screening unit 40.

As illustrated in FIG. 7, the first screening unit 40 has: the mesh unit 41; disk units 44, 45; an inlet port 46; and a discharge port 47. The first screening unit 40 is a rotational sieve where the mesh unit 41 is rotated about an axis of rotation Q by a motor (not shown). The rotation of the mesh unit 41 causes any defibrated material inside the mesh unit 41 that is of a size able to pass through the first openings 42 to pass through, and causes any defibrated material that is of a size unable to pass through the first openings 42 not to pass through.

A plurality of the first openings 42 are provided to the mesh unit 41 of the first screening unit 40. The mesh unit 41 is constituted of a wire mesh, such as a flat-woven wire mesh or a welded wire mesh. The mesh unit 41 is obtained by shaping a wire mesh into a cylinder, and the interior of the cylinder is hollow. Because of the difficulty of making a perfect circle, a "cylindrical shape" is understood to also encompass ellipses that are not exact circles, and to encompass polygons as well.

With the first screening unit 40, instead of the mesh unit 41 constituted of wire mesh, an expanded metal obtained when a metal sheet that has been scored is stretched longer may be used, or a punched metal obtained when holes are formed with a pressing machine or the like in a metal sheet may be used. In a case where an expanded metal is used, then the first openings 42 would refer to holes formed when the scores made in the metal sheet are stretched longer. In a case where a punched metal is used, then the first openings 42 would refer to the holes formed with the pressing machine or the like in the metal sheet. The member that has the first openings 42 may also be made with a substance other than a metal.

The first openings 42 provided to the mesh unit 41 of the first screening unit 40 are the holes of the mesh unit 41. The mesh unit 41, as illustrated in FIG. 8, has a plurality of linear line units 43 composed of a metal, and the first openings 42 are portions surrounded by the line units 43. The shape of the first openings 42 is not particularly limited, provided that the first screening unit 40 functions as a sieve, and may be polygonal, circular, elliptical, or the like; however, in the example illustrated in FIG. 8, the shape is a square. Preferably, the plurality of first openings 42 have the same size and shape. Preferably, the plurality of first openings 42 are arranged evenly.

The "shape of the first openings", in a case where the mesh unit 41 is a cylinder, refers to the planar shape of the first openings 42 in a case where the cylindrical mesh unit 41 is expanded. The language relating to the first openings above applies also to the "second openings", described below.

The mesh size of the mesh unit 41 of the first screening unit 40 is preferably 70 to 2,000 μm. This causes the defibrated material (fibers) smaller than 70 μm to be screened by passing through the first openings 42. Fibers smaller than 70 μm are too short, so when the fibers bind to one another, there are instances where the fibers that need to bind are not found close by and cannot bind. In such a case, the strength of the resulting sheet is adversely affected. When the mesh size is smaller than 70 μm, there is a greater likelihood that mesh clogging could occur. When the mesh size is greater than 2,000 μm, there is a greater likelihood that the undefibrated pieces 4 that have not been defibrated could pass through the first openings 42.

The "mesh size" refers to the size A between adjacent line units 43 in a case where the mesh unit 41 is expanded as illustrated in FIG. 8. In the case where the shape of the first openings 42 is a square, then the mesh size is the length of one side of the square.

The disk units 44, 45 of the first screening unit 40 are arranged in two openings formed at the end parts by when the mesh unit 41 is made into a cylinder. The inlet port 46 for introducing the defibrated fibers is provided to the disk unit 44, and the discharge port 47 for discharging the residual material is provided to the disk unit 45. When the screening unit 40 is rotating, the mesh unit 41 rotates; the disk units 44, 45, the inlet port 46, and the discharge port 47 do not rotate. The disk units 44, 45 are in contact with the end parts of the mesh unit 41 such that the mesh unit 41 is able to rotate. The disk units 44, 45 and the mesh unit 41 are in direct contact with no gap therebetween, and this prevents the defibrated material inside the mesh unit 41 from leaking out. The positions of the inlet port 46 and the discharge port 47 are provided to positions deviated from the axis of rotation Q of the first screening unit 40 in the example illustrated in FIG. 7. More specifically, in the example illustrated in FIG. 7, the inlet port 46 is provided vertically above the axis of rotation Q and below a vertically uppermost part of the mesh unit 41. The discharge port 47 is provided vertically below the axis of rotation Q and above a vertically lowermost part of the mesh unit 41. The defibrated material that does not pass through the first openings 42 collects in the interior of the mesh unit 41. Positioning the inlet port 46 vertically above the axis of rotation Q makes it possible to supply the defibrated material to a space where the defibrated material does not collect, and therefore prevents the defibrated material from becoming backed up where the inlet port 46 is. Also, the defibrated material that does not pass through the first openings 42 collects at a vertically lower part, and therefore is more readily discharged due to the provision of the discharge port 47 to vertically below the axis of rotation Q. The diameters of the inlet port 46 and the discharge port 47 are smaller than the radius of the cylinder of the mesh unit 41. This prevents there from being too much of the defibrated material supplied to the inlet port 46, which would cause the interior of the mesh unit 41 to fill with the defibrated material. This also curbs any instances where the defibrated material is discharged from the discharge port 47 without adequate screening.

The mesh unit 41 of the first screening unit 40 is movable. The mesh unit 41 is able to rotate about the axis of rotation Q in FIG. 7. The first openings 42 also rotate along with the rotation of the mesh unit 41. The rotational speed of the mesh unit 41 is, for example, 50 to 800 rpm, preferably 130 to 200 rpm. Preferably, the speed of motion of the mesh unit 41 of the first screening unit 40 is greater than the speed of motion of a mesh unit 51 of the second screening unit 50. That is to say, the mesh unit 41 of the first screening unit 40 moves faster than the mesh unit 51 of the second screening unit 50. Here, in a case where the mesh units 41, 51 are rotated, the "speed of motion" could also be referred to as the rotational speed of the mesh units 41, 51. That is to say, the rotational speed of the mesh unit 41 of the first screening unit 40 is greater than the rotational speed of the mesh unit 51 of the second screening unit 50. The mesh unit 41 need not only rotate but may also move in the horizontal direction or the vertical direction. "Movement" or "motion" is therefore understood to comprise rotation, rectilinear motion, reciprocal motion in the shape of a pendulum, and the like, and "speed of motion" is therefore understood to comprise the speed of motion in the respective direction, or the frequency or oscillation frequency. The language relating to "movement" or "motion" also applies to the "second openings" described below.

In the state where the first screening unit 40 is rotating about the axis of rotation Q, the defibrated material that has undergone the defibration treatment is introduced to the first screening unit 40 from the inlet port 46. The rotation of the mesh unit 41 causes some of the defibrated material to pass through the first openings 42 and be discharged to the exterior of the first screening unit 40 as the first passage material α1, as illustrated in FIG. 2. Another part of the defibrated material, as the first residual material β1, does not pass through the first openings 42 and rides the air flow to be discharged from the discharge port 47. In this manner, the mesh unit 41 to which the first openings 42 are provided is used by the first screening unit 40 to separate the defibrated material into the first passage material α1 and the first residual material β1.

Here, the first passage material α1 is constituted primarily of short fibers (short, unraveled fibers), and the first residual material β1 is constituted primarily of fibers 2 (long, unraveled fibers) longer than the first passage material α1 and of the undefibrated pieces 4. The mean fiber length of the fibers 2 included in the first passage material α1 is shorter than the mean fiber length of the fibers 2 included in the first residual material β1. As such, the fibers 2 included in the first passage material α1 could also be called "short fibers".

Having been screened at the first screening unit 40, the first residual material β1 is introduced to the second screening unit 50 via the third transferring unit 73. That is to say, the defibrated material 2 that does not pass through the first openings 42 is transferred to the second screening unit 50 by the third transferring unit 73.

Figure 9:
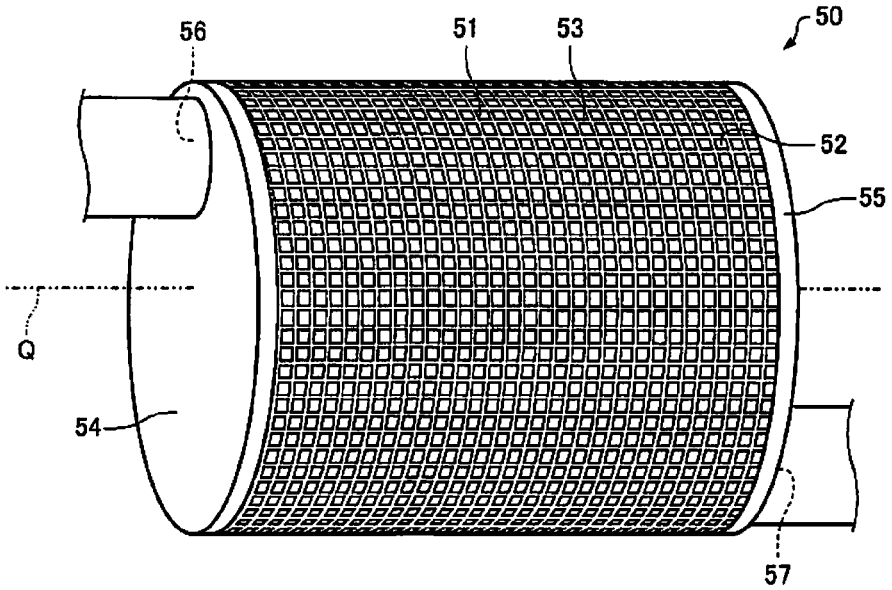
FIG. 9 is a perspective view for schematically illustrating a second selection unit of a sheet manufacturing apparatus as in the first embodiment.

A sieve is used as the second screening unit 50. Here, FIG. 9 is a perspective view schematically illustrating the second screening unit 50. The second screening unit 50, as illustrated in FIG. 9, has: the mesh unit 51; disk units 54, 55; the inlet port 56; and the discharge port 57. The second screening unit 50 is a rotational sieve where the mesh unit 51 is rotated about an axis of rotation Q by a motor (not shown). The rotation of the mesh unit 51 causes any defibrated material inside the mesh unit 51 that is of a size able to pass through the second openings 52 to pass through, and causes any defibrated material that is of a size unable to pass through the second openings 52 not to pass through.

Other than in having the mesh unit 51 to which the second openings 52 are provided instead of the mesh unit 41 to which the first openings 42 are provided, the second screening unit 50 has essentially the same shape as the first screening unit 40. In the following description of the second screening unit 50, any description of portions that have the same shape as those of the first screening unit 40 is omitted.

The plurality of second openings 52 are provided to the mesh unit 51 provided to the second screening unit 50. The shape of the second openings 52 may be the same as the shape of the first openings 42 of the first screening unit 40. The size of the second openings 52 is greater than the size of the first openings 42.

The "size of the openings" refers to the surface area of the openings in a state where the mesh units 41, 51 have been developed in a case where the mesh units 41, 51 are cylinders, as is illustrated in FIGS. 7 and 9. More specifically, in a case where the mesh units 41, 51 are constituted of a metal mesh (more specifically, a case where the shape of the openings 42, 52 is square), then the "size of the openings" may be the mesh size of the mesh units 41, 51. In a case where the openings 42, 52 is circular, then the "size of the openings" may be the diameter of the openings 42, 52. In cases other than where the openings 42, 52 are squares or circles, the "size of the openings" may be understood to be the dimension of a portion where the dimensions are greatest.

The mesh unit 51 of the second screening unit 50 is movable. More specifically, the mesh unit 51 is able to rotate about the axis of rotation Q, as illustrated in FIG. 9. The second openings 52 also rotate along with the rotation of the mesh unit 51. The rotational speed of the mesh unit 51 is, for example, 30 to 600 rpm, preferably 100 to 180 rpm.

In a state where the second screening unit 50 is rotating about the axis of rotation Q, the first residual material β1 that did not pass through the first openings 42 is introduced to the second screening unit 50 from the inlet port 56. Then, the rotation of the mesh unit 51 causes a part of the first residual material β1 to pass through the second openings 52 and be discharged to the exterior of the second screening unit 50, as the second passage material α2, as illustrated in FIG. 2. Another part of the first residual material β1 does not pass through the second openings 52 and rides the air flow to be discharged from the discharge port 57 as the second residual material β2. In this manner, the mesh unit 51 to which the second openings 52 are provided is used by the second screening unit 50 to separate the first residual material β1 into the second passage material α2 and the second residual material β2.

Preferably, the mesh size of the mesh unit 51 of the second screening unit 50 is 550 μm to 2,000 μm. When the mesh size is smaller than 550 μm, then there is a smaller difference from the magnitude of the mesh size of the mesh unit 41 of the first screening unit 40, there is more of the first passage material α1 and the second residual material β2 than the second passage material α2, and there ends up being less of the defibrated material that is used in the manufacturing of the sheet. When the mesh size is larger than 2,000 μm, then there is a greater likelihood that the undefibrated pieces 4 that are not defibrated will pass through the second openings 52. Now, as described above, the mesh size of the mesh unit 51 is greater than the mesh size of the mesh unit 41; for example, in a case where the mesh size of the mesh unit 41 is 234 μm and the line diameter (the width W of the line units 43 illustrated in FIG. 8) is 33 μm, then the mesh size of the mesh unit 51 is 1,100 μm and the line diameter is 300 μm.

Having been separated out at the second screening unit 50, the second residual material β2 is discharged from the discharge port 57 of the second screening unit 50, transferred to the crushing unit 10 via a fourth transferring unit 74, and again introduced to the defibrating unit 20. Thus, the fourth transferring unit 74 is a return transferring unit with which the second residual material β2 (residual material comprising the undefibrated pieces 4, the entangled fibers 2, and the long fibers) that did not pass through the second openings 52 can be returned to the defibrating unit 20. The shape of the fourth transferring unit 74 is not particularly limited, provided that the second residual material β2 can be returned to the crushing unit 10, but in the example illustrated in FIG. 2, the shape of the fourth transferring unit 74 is configured so as to comprise tubular tube units 74*a* and a hopper 74*b*. The arrow R in FIG. 1 illustrates a path of the second residual material β2 that is transferred by the fourth transferring unit 74.

The sheet forming unit 60, as illustrated in FIG. 3, has a depositing unit 62 for receiving and depositing the second passage material α2 (defibrated material) screened at the screening unit 30, stretching rollers 64, heater rollers 66, a tension roller 67, and a take-up roller 68. The sheet forming unit 60 forms a sheet with the defibrated material (the defibrated material that does not pass through the first openings 42 and does pass through the second openings 52) that is received by the depositing unit. The sheet forming unit 60 shall be described below in greater detail.

The depositing unit 62 of the sheet forming unit 60 receives and deposits the second passage material α2 (defibrated material) that passed through the second openings 52. The depositing unit 62 is located below the second screening unit 50. The depositing unit 62 is for receiving the defibrated material that passed through the second openings 52, and is, for example, a mesh belt. Formed in the mesh belt is a mesh that is stretched by the stretching rollers 64. The depositing unit 62 is moved by when the stretching rollers 64 turn. While the depositing unit 62 is moving continuously, the defibrated material is continuously fall and pile up from the second screening unit 50, thereby forming a web of even thickness on the depositing unit 62.

Though not depicted, there may be provided a suction apparatus that is located below the second screening unit 50, with the depositing unit 62 therebetween, and generates an air flow oriented downward (an air flow going from the second screening unit 50 toward the depositing unit 62). The suction apparatus makes it possible to suction the defibrated material that is dispersed in the air, and makes it possible to increase the speed of discharge from the second screening unit 50. As a consequence, the productivity of the sheet manufacturing apparatus 100 can be raised. The suction apparatus also makes it possible to form a down-flow on a path of descent of the defibrated material, making it possible to prevent the defibrated material from entangling during the descent.

The material of the mesh belt that is used as the depositing unit 62 of the sheet forming unit 60 is metal, resin, nonwoven fabric, or the like. The hole size (diameter) of the mesh belt is, for example, 60 to 250 μm. When the hole size of the mesh belt is smaller than 60 μm, then in some instances it is difficult for a stable air flow to be formed by the suction apparatus. When the hole size of the mesh belt is larger than 250 μm, then in some instances the fibers enter in between the mesh and any irregularities in the surface of the sheet thus manufactured are larger.

The defibrated material that is deposited onto the depositing unit 62 of the sheet forming unit 60 is heated and compressed by being passed through the heater rollers 66 along with the movement of the depositing unit 62. This causes a plurality of defibrated materials to bond to one another and pass through calender rollers (not shown) to level the surface, thus forming a sheet P. In the example depicted, the sheet P is taken up at the take-up roller 68.

Per the foregoing, the sheet P can be manufactured.

The sheet manufacturing apparatus 100 has, for example, the following features.

The sheet manufacturing apparatus 100 comprises the screening unit 30 for screening the defibrated material obtained by defibration treatment, and the sheet forming unit 60 for forming the sheet with the defibrated material screened at the screening unit 30, the screening unit 30 having the first screening unit 40 to which the plurality of first openings 42 are provided and the second screening unit 50 to which the plurality of second openings 52 that are larger than the first openings 42 are provided, the defibrated material being screened by the first screening unit 40 and the second screening unit 50, and the sheet forming unit 60 forming the sheet with the defibrated material that does not pass through the first openings 42 and does pass through the second openings 52. With the sheet manufacturing apparatus 100, there are the two screening units which have openings of different sizes, and the sheet is formed using the defibrated material that does not pass through the comparatively smaller openings (the first openings 42) and does pass through the comparatively larger openings (the second openings 52). Here, either the first openings 42 or the second openings 52 may be on the upstream side in the direction of transfer of the defibrated material, where one is on the upstream side and the other is on the downstream side. With the sheet manufacturing apparatus 100 of such description, the sheet is formed without using short fibers, which would end up passing through the first openings 42, and without using long fibers or undefibrated pieces that do not pass through the second openings 52. This makes it possible to even the density of when the sheet is made, makes it possible to eliminate portions of inadequate strength, and makes it possible to manufacture a very strong sheet.

It is also possible to manufacture a sheet having a favorable texture.

Per the foregoing, the sheet manufacturing apparatus 100 is able to manufacture a sheet having high strength and favorable texture. The "strength of the sheet" refers to the tensile strength of the sheet, and more specifically refers to a strength that is assessed using a tensile strength testing machine. The "texture" refers to the quality of the sheet, and more specifically refers to the degree (extent) of a difference in shade that is seen when light hits from the back side of the sheet. That is to say, a "sheet having a favorable texture" refers to a sheet with which this difference in shade is small.

With the sheet manufacturing apparatus 100, the first screening unit 40 and the second screening unit 50 are movable, and the speed of motion of the first screening unit 40 is greater than the speed of motion of the second screening unit 50. Here, the first openings 42 provided to the first screening unit 40 are smaller than the second openings 52 provided to the second screening unit 50. The first passage material α1 that passes through the first openings 42 is short fibers such as would result in adequate strength when made into a sheet, and there is less than the residual material β1 that does not pass through the first openings 42. The residual material β2 that does not pass through the second openings 52, however, is long fibers and undefibrated pieces, and there is less than the passage material α2 that does pass through the second openings 52. When the first screening unit 40 and the second screening unit 50 have the same speed of motion, then it is more difficult to pass through the openings for the first screening unit 40, with which there is more residual material, than the second screening unit 50, with which there is less residual material. Therefore, having the swing speed of the first screening unit 40 be greater than the swing speed of the second screening unit 50 facilitates passage through the first openings 42.

The sheet manufacturing apparatus 100 comprises the defibrating unit 20 for subjecting the material to be defibrated to the defibration treatment, as well as the return transferring unit 74 for returning the second residual material β2 (for example, second residual material comprising the undefibrated pieces 4 and the fibers that have become entangled with one another and become larger) that did not pass through the second openings 52 to the defibrating unit 20. This makes it possible for the undefibrated pieces 4, which were not screened at the screening unit 40, to undergo the defibration treatment in the defibrating unit 20. That is to say, the undefibrated pieces 4 are not discarded but instead are utilized to manufacture sheets.

Second Embodiment

Figure 10:
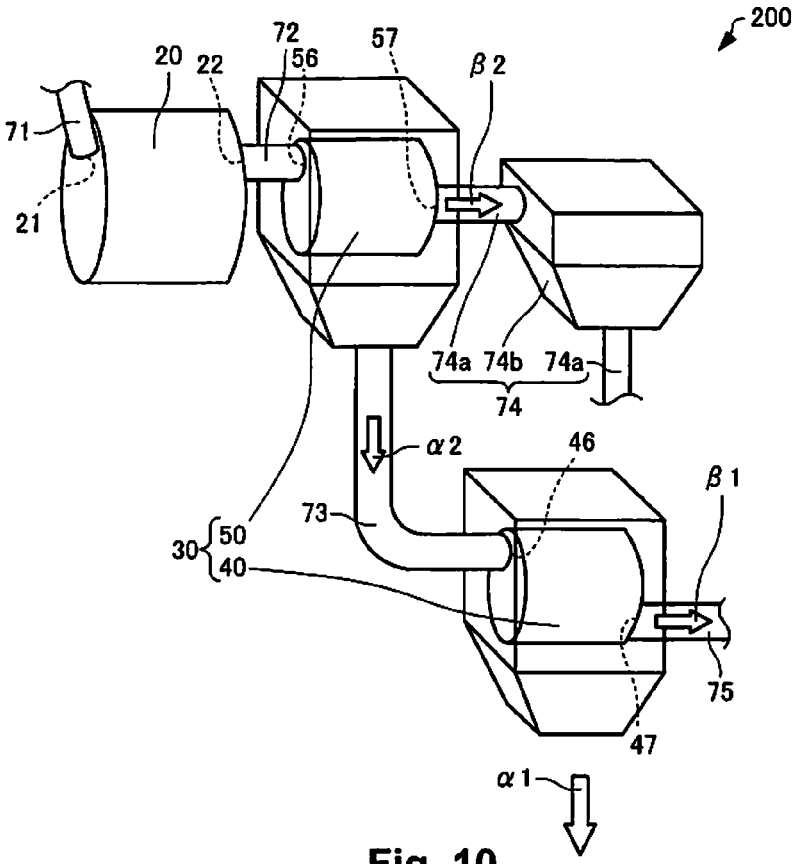
FIG. 10 is a drawing for schematically illustrating a defibrating unit and selection units of a sheet manufacturing apparatus as in a second embodiment.

A sheet manufacturing apparatus as in a second embodiment shall be described next, with reference to the accompanying drawings. FIG. 10 is a drawing schematically illustrating the defibrating unit 20 and the screening unit 30 of a sheet manufacturing apparatus 200 as in the second embodiment, and corresponds to FIG. 2. Described below are matters where the sheet manufacturing apparatus 200 as in the second embodiment differs from the example of the sheet manufacturing apparatus 100 as in the first embodiment; any description of similar matters is omitted.

In the sheet manufacturing apparatus 100, as illustrated in FIG. 2, the third transferring unit 73 transfers to the second screening unit 50 the defibrated material that does not pass through the first openings 42. That is to say, with the sheet manufacturing apparatus 100, the defibrated material generated in the defibrating unit 20 is first introduced to the first screening unit 40 and thereafter introduced to the second screening unit 50. In other words, the screening at the first screening unit 40 is followed by the screening at the second screening unit 50.

By contrast, with the sheet manufacturing apparatus 200, the third transferring unit 73 transfers to the first screening unit 40 the defibrated material that does pass through the second openings 52, as illustrated in FIG. 10. In other words, with the sheet manufacturing apparatus 200, the defibrated material generated at the defibrating unit 20 is first introduced to the second screening unit 50 and thereafter introduced to the first screening unit 40. In other words, the screening at the second screening unit 50 is followed by the screening at the first screening unit 40.

More specifically, in the screening unit 30 of the sheet manufacturing apparatus 200, the defibrated material that is discharged from the defibrating unit 20 is introduced to the second screening unit 50 via the second transferring unit 72. A composite that is introduced is separated by the second screening unit 50 into the second passage material $\alpha 2$ and the second residual material $\beta 2$. The second passage material $\alpha 2$ thus separated is transferred to the first screening unit 40 via the third transferring unit 73. The second passage material $\alpha 2$ thus introduced is separated by the first screening unit 40 into the first passage material $\alpha 1$ and the first residual material $\beta 1$. The first residual material $\beta 1$ thus separated is deposited onto the depositing unit 62 via a fifth transferring unit 75, and the sheet forming unit 60 uses the first residual material $\beta 1$ to form the sheet. In this manner, at the screening unit 30, the second passage material $\alpha 2$ is screened from the composite at the second screening unit 50 and the first residual material $\beta 1$ is screened from the second passage material $\alpha 2$ at the first screening unit 40.

With the sheet manufacturing apparatus 200, the second passage material $\alpha 2$ is constituted mainly of the short fibers 2 (short, unraveled fibers), and the second residual material $\beta 2$ is constituted mainly of the undefibrated pieces 4.

With the sheet manufacturing apparatus 200, the first passage material al is constituted mainly of the short fibers 2 (short, unraveled fibers) and the first residual material $\beta 1$ is constituted mainly of the fibers 2 (long, unraveled fibers) longer than the first passage material $\alpha 1$. The mean fiber length of the fibers 2 included in the first passage material $\alpha 1$ is shorter than the mean fiber length of the fibers 2 included in the first residual material $\beta 1$. As such, the fibers 2 included in the first passage material $\alpha 1$ could also be called "short fibers".

With the sheet manufacturing apparatus 200, as is true of the sheet manufacturing apparatus 100, it is possible to produce a sheet that has high strength and favorable texture.

The sheet manufactured by the sheet manufacturing apparatus 100, 200 refers mainly to when something is made into a sheet. There is no limitation to being sheet-like, however, and the sheet may be board-like or web-like. The sheet in the present specification can be divided into paper or non-woven fabric. Paper encompasses modes where pulp or used paper, as a stock material, is formed into a thin sheet, or the like, and encompasses recording paper, wallpaper, wrapping paper, colored paper, picture paper, Kent paper, or the like where writing or printing is the objective. Non-woven fabric is thicker or of lower strength than paper, and encompasses non-woven fabric, fiber board, tissue paper, kitchen paper, cleaners, filters, liquid-absorbing material, sound-absorbing material, cushioning material, mats, and the like. The stock material may also be cellulose or other plant fibers, polyethylene terephthalate (PET), polyester, or other chemical fibers, or wool, silk, or other animal fibers.

The mesh unit 41 of the first screening unit 40 and the mesh unit 51 of the second screening unit 50 were understood to by cylindrical, but may also be planar. A plurality of openings may be opened in a flat plate, or the mesh units may be planar meshes.

Though not depicted, a classifying unit may be provided between the defibrating unit 20 and the screening unit 30 (amidst the pathway on which the defibrated material discharged from discharge port 22 goes from the defibrating unit 20 toward the screening unit 30). This makes it possible to reduce the possibility of fine powder being introduced to the screening unit 30. More specifically, as the classifying unit, a cyclone, elbow jet, eddy classifier, or the like is used.

Though not depicted, the first screening unit 40 may be inclined from the horizontal direction so that the discharge port 47 is located below with respect to the inlet port 46. Similarly, the second screening unit 50 may be inclined from the horizontal direction so that the discharge port 57 is located below with respect to the inlet port 56. This makes it possible to utilize the force of gravity and make it easier for the residual materials $\beta 1$, $\beta 2$ to be discharged from the discharge ports 47, 57.

Though not depicted, the first screening unit 40 may be of such a shape that the diameter of the cylindrical mesh unit 41 increases going from the inlet port 46 toward the discharge port 47. Similarly, the second screening unit 50 may be of such a shape that the diameter of the cylindrical mesh unit 51 increases going from the inlet port 56 toward the discharge port 57. This makes it possible to make it easier for the residual materials $\beta 1$, $\beta 2$ to be discharged from the discharge ports 47, 57.

Though not depicted, a resin supplying unit for supplying a resin (a resin for bonding the defibrated material) to the defibrated material that passes through the first openings 42 and does not pass through the second openings 52 may be provided. The resin supplied from the resin supplying unit is, for example, a thermoplastic resin, and is softened by being passed through the heater roller 66, thus functioning as a binder and making it possible to bind the defibrated material 2. Specific examples of the resin supplied from the resin supplying unit could include AS resin, ABS resin, polypropylene, polyethylene, polyvinyl chloride, polystyrene, acrylic resins, polyester resins, polyethylene terephthalate, polyphenylene ether, polybutylene terephthalate, nylon, polyamide, polycarbonate, polyacetal, polyphenylene sulfide, and polyether ether ketone. These resins may be used independently or mixed as appropriate.

Though not depicted, in the case of the sheet manufacturing apparatus 100, an unraveling unit for unraveling the entangled defibrated material. Though not particularly limited, the mode of the unraveling unit may have, for example, a mesh unit able to swing, where causing the mesh unit to swing unravels the entangled defibrated material. This makes it possible to uniformly disperse the defibrated material onto the depositing unit 62.

Though not depicted, a water sprayer for spraying and adding moisture to the deposited product deposited onto the depositing unit 62 may also be provided. This makes it possible to increase the strength of the hydrogen bonds for when the sheet P is formed. The water is sprayed and added to the deposited product that has not yet passed through the heater roller 66. Starch or polyvinyl alcohol (PVA) or the like may be added to the moisture that is sprayed with the water sprayer. This makes it possible to further increase the strength of the sheet P.

The example given above described a mode where the sheet P is taken up at the take-up roller 68, but the sheet P may also be cut to a desired size by a cutter (not shown) and loaded onto a stacker or the like.

In the example given above, the second screening unit 50 need not move, provided that screening remains possible even without movement. For example, an air flow may be used to cause passage through the second openings 52.

The embodiments and modification examples given above are given by way of example, and there is not necessarily limitation thereto. For example, each of the embodiments and each of the modification examples could also be combined as appropriate.

The present invention encompasses configurations (for example, configurations where the functions, methods, and results are the same, or configurations where the objectives and effects are the same) that are essentially the same as the configurations described in the embodiments. The present invention also encompasses configurations where non-essential portions of the configurations described in the embodiments are replaced. The present invention furthermore encompasses configurations exerting the same effects or configurations able to achieve the same objectives as those of the configurations described in the embodiments. The present invention additionally encompasses configurations where known features are added to the configurations described in the embodiments.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sheet manufacturing apparatus, comprising a screening unit configured to screen a defibrated material obtained by defibration treatment, and a sheet forming unit configured to form a sheet with the defibrated material screened by the screening unit, the screening unit having a first screening unit to which a plurality of first openings are provided and a second screening unit to which a plurality of second openings larger than the first openings are provided, the defibrated material being screened by the first screening unit and the second screening unit, the defibrated material being screened by one of the first screening unit and the second screening unit, and thereafter screened by the other of the first screening unit and the second screening unit, and the sheet forming unit being configured to form the sheet with the defibrated material that does not pass through the first openings and passes through the second openings.

2. The sheet manufacturing apparatus as set forth in claim 1, wherein the first screening unit is movable, and the first screening unit is configured to move faster than the second screening unit.

3. The sheet manufacturing apparatus as set forth in claim 1, wherein the first screening unit is movable, the second screening unit is movable, and the first screening unit is configured to move faster than the second screening unit.

4. The sheet manufacturing apparatus as set forth in claim 1, further comprising a transferring unit configured to transfer, to the second screening unit, the defibrated material that does not pass through the first openings.

5. The sheet manufacturing apparatus as set forth in claim 1, further comprising a transferring unit configured to transfer, to the first screening unit, the defibrated material that passes through the second openings.

6. The sheet manufacturing apparatus as set forth in claim 1, further comprising a defibrating unit configured to perform the defibration treatment of a material to be defibrated, and a return transferring unit configured to return to the defibrating unit the defibrated material that does not pass through the second openings.

7. The sheet manufacturing apparatus as set forth in claim 1, wherein the sheet forming unit includes a depositing unit configured to receive and deposit the defibrated material screened by the screening unit, and the sheet forming unit is configured to form the sheet with the defibrated material received by the depositing unit.

* * * * *